US005616538A

United States Patent [19]

Hey-Shipton et al.

[11] Patent Number: 5,616,538

[45] Date of Patent: Apr. 1, 1997

[54] HIGH TEMPERATURE SUPERCONDUCTOR STAGGERED RESONATOR ARRAY BANDPASS FILTER

[75] Inventors: Gregory L. Hey-Shipton; George L. Matthaei, both of Santa Barbara, Calif.

[73] Assignee: Superconductor Technologies, Inc., Santa Barbara, Calif.

[21] Appl. No.: 254,313

[22] Filed: Jun. 6, 1994

[51] Int. Cl.[6] ..... H01P 1/203; H01B 12/06

[52] U.S. Cl. ..... 505/210; 505/700; 505/701; 505/866; 333/99 S; 333/204; 333/205

[58] Field of Search ..... 333/204, 205, 333/99 S; 505/210, 700, 701, 866

[56] References Cited

U.S. PATENT DOCUMENTS

| | | | |
|---|---|---|---|
| 3,925,740 | 12/1975 | Steensma | 333/226 X |
| 4,701,727 | 10/1987 | Wong | 333/204 |
| 5,066,933 | 11/1991 | Komeda | 333/204 |
| 5,231,078 | 7/1993 | Reibman et al. | 333/175 X |

FOREIGN PATENT DOCUMENTS

| | | | |
|---|---|---|---|
| 19301 | 1/1985 | Japan | 333/204 |
| 220602 | 11/1985 | Japan | 333/204 |
| 254501 | 11/1987 | Japan | 333/204 |
| 1709438 | 1/1992 | Russian Federation | 333/204 |
| 572865 | 9/1977 | U.S.S.R. | 333/204 |
| 1224862 | 4/1986 | U.S.S.R. | 333/204 |
| 1277256 | 12/1986 | U.S.S.R. | 333/204 |
| 1385165 | 3/1988 | U.S.S.R. | 333/204 |
| 1541690 | 2/1990 | U.S.S.R. | 333/204 |

OTHER PUBLICATIONS

Winter, Frederick J., "High Dielectric Constant Strip Line Band Pass Filters," IEEE Transactions on Microwave Theory and Techniques, vol. 39, No. 12, Dec., 1991, pp. 2182–2187.

Matthaei, G.L. et al, "High Temperature Superconducting 8.45 GHz Bandpass Filter for the Deep Space Network," 1993 IEEE MTT-5 International Symposium Digest, Jun. 14–18, 1993, Atlanta, Georgia, pp. 1273–1276.

Howe, Harlan, Jr., "Stripline Circuit Design," Archtech House, Inc., 1974, pp. 216–217.

Levy, R., "Three-Wire-Line Interdigital Filters of chebyshev and Elliptic-Function Characteristic for Broad Bandwidths," Electronic Letters, vol. 2, Dec. 2, 1966, pp. 13–14.

Schmidt, Michael et al, "Measured Performance at 77K of Superconducting Microstrip Resonators and Filters," IEEE Transactions on Microwave Theory and Technical Techniques, vol. 39, No. 9, Sep. 1991, pp. 1475–1478.

Talisa, Salvador H. et al, "Low-and High-Temperature Superconducting Microwave Filters," IEEE Transactions on Microwave Theory and Techniques, vol. 39, No. 9, Sep. 1991, pp. 1448–1454.

*Primary Examiner*—Benny T. Lee
*Attorney, Agent, or Firm*—Lyon & Lyon

[57] ABSTRACT

A bandpass filter comprises multiple side-coupled strip line resonators wherein the resonators are staggered or offset with respect to their nearest neighbors by substantially ¼ wavelength or less. In the preferred embodiment, the strip line bandpass filter structure has substantially parallel resonators arrayed with substantially constant spacing between the resonators with ¼ wavelength overlap or less. Generally, the amount of stagger between nearest neighbors is reduced for resonators toward the center of the filter. Coupling between resonators is controlled by varying the relative amount of stagger between resonators. The resonators may be formed from normal metal or superconducting materials, such as YBCO or thallium containing superconductors. A strip line structure may be formed by utilizing two mirror structures each comprising a substrate having a ground plane and a patterned staggered resonator array formed on the substrate on a side opposite the ground plane. In another aspect of this invention, a ground plane tuning system utilizes a variable positioning member. The member is moveable towards and away from the resonator array, resulting in tuning. In the preferred embodiment, a threaded plug mates with a threaded housing opening, permitting tuning by rotation of the insert.

3 Claims, 6 Drawing Sheets

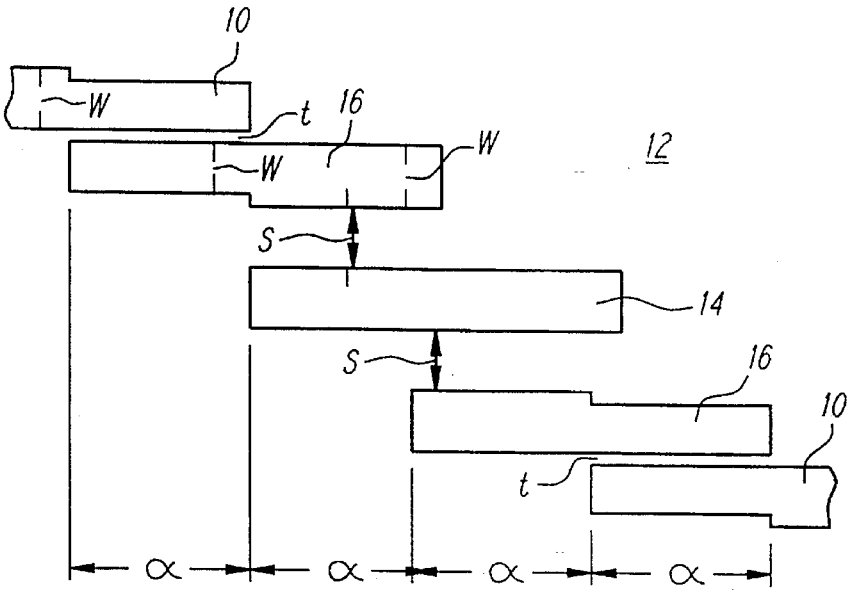
FIG. 1
(PRIOR ART)
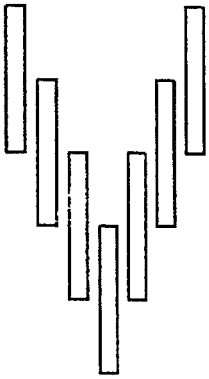
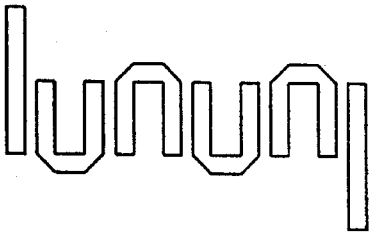
FIG. 2b
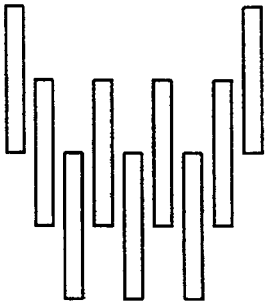
FIG. 2a
FIG. 2c

HIGH TEMPERATURE SUPERCONDUCTOR STAGGERED RESONATOR ARRAY BANDPASS FILTER

FIELD OF THE INVENTION

This invention relates to bandpass filters for microwave or millimeter wave devices. More particularly, it relates to narrow bandpass filters utilizing thin films or high temperature superconducting films formed from half wavelength resonators in a parallel coupled array.

BACKGROUND OF THE INVENTION

Filters have long been used in the detection of electrical signals. For example, in communications applications, such as microwave applications, it is desirable to filter out the smallest possible passband. In this way, it is possible to divide a fixed frequency spectrum up into the largest possible number of bands. Narrow bandpass filters typically have a fractional bandwidth (absolute bandwidth divided by the center frequency) of less than substantially 10%, and more preferably less than 5%.

Applications in the telecommunications field are of particular importance. As more users desire to use the microwave band, the use of narrow band filters will increase the number of users in the spectrum. Of most particular importance is the frequency range from approximately 800–2,200 MHz. In the United States, the 800–900 MHz range is used for analog cellular communications. Personal communication services are planned for the 1,800 to 2,200 MHz range.

Historically, filters have fallen into three broad categories. First, lumped element filters have used separately fabricated air wound inductors and parallel plate capacitors, wired together to form a filter circuit. These conventional components are relatively small compared to the wave length, and accordingly, make for a fairly compact filter. However, the use of separate elements has proved to be difficult in manufacture, resulting in large circuit to circuit variations. The second conventional filter structure utilizes 3-dimensional distributed element components. These physical elements are sizeable compared to the wavelength. Coupled bars or rods are used to form transmission line networks which are arranged as filter circuit. Ordinarily, the length of the bars or rods is ¼ or ½ of the wavelength at the center frequency of the filter. Accordingly, the bars or rods can become quite sizeable, often being several inches long, resulting in filters over a foot in length. Third, printed distributed element filters have been used. Generally, they comprise a single layer of metal traces printed on an insulating substrate, with a ground plane on the back of the substrate. The traces are arranged as transmission line networks to make a filter. Again, the size of these filters can become quite large. The structures also suffer from various responses at multiples of the center frequency.

Historically, filters have been fabricated using normal, that is, non-superconducting materials. These materials have inherent lossiness, and as a result, the circuits formed from them have varying degrees of loss. For resonant circuits, the loss is particularly critical. The Q of a device is a measure of its power dissipation or lossiness. Resonant circuits fabricated from normal metals in a microstrip or stripline configuration have Qs at best on the order of four hundred. See, e.g., F. J. Winters, et al., "High Dielectric Constant Strip Line Band Pass Filters", IEEE Transactions On Microwave Theory and Techniques, Vol. 39, No. 12, Dec. 1991, pp. 2182–87.

With the discovery of high temperature superconductivity in 1986, attempts have been made to fabricate electrical devices from these materials. The microwave properties of the high temperature superconductors has improved substantially since their discovery. Epitaxial superconductive thin films are now routinely formed and commercially available. See, e.g., R. B. Hammond et al, "Epitaxial $Tl_2Ca_1Ba_2Cu_2O_8$ Thin Films With Low 9.6 GHz Surface Resistance at High Power and Above 77° K.", Applied Physics Letters Appl. Phy. Lett., Vol. 57, pp 825–27, 1990.

In theory, devices with zero resistance should have an infinite Q. However, even superconductive devices are not perfectly lossless at high frequencies. However, they do have exceedingly high Qs. For example, a thallium superconductor strip line resonator at 8.45 GHz has been measured with a Q of 26,000 as compared to a Q of literally a few hundred for the best conventional metal resonator. (See, Winter, et al., cited above.)

Various filter structures have been formed utilizing significant superconductive components. For example, a narrow band microwave filter is shown in plan view in FIG. 1, which structure is taken in substantially part from European patent application 0357507, subject to common assignment with the instant application. This narrow band filter is formed in a microstrip configuration, that is, one in which the conductor faces a dielectric environment which is not uniform around the conductor. In the structure of FIG. 1, the conductors generally are deposited upon a dielectric substrate and are only exposed to air above the conductors, thereby creating a difference in the dielectric constant above and below the conductors. In FIG. 1, connectors 10, having a width designated "w" on FIG. 1, serve as input and output connections to the overall filter 12. Generally, the filter 12 is symmetrical around the longitudinal center line of the center resonator 14. Intermediate resonators 16 are arranged with a ¼ wavelength overlap (a) between each of the input 10 and center resonator 14. In this microstrip configuration, the bandpass filter characteristics are substantially varied by adjusting the spacing S between the center resonator and intermediate resonator 16 relative to the spacing "t" between the connectors 10 and intermediate resonator 16.

FIGS. 2*a*, 2*b* and 2*c* shows various prior art configurations of normal metal half wave resonators in a side coupled arrangement. Each of the filters in FIGS. 2*a*, and 2*c* show half wave resonators where the overlap to the nearest neighbor is substantially ¼ wavelength. These figures show common methods of folding side-coupled half-wave filters. See, Harlan Howe, Jr., Strip Line Circuit Design, Microwave Associates, Burlington, Mass., Artech House, Inc., 1974, pp 217. The filters are described in the Howe article as in a pyramid configuration (FIG. 2*a*), a hairpin configuration (FIG. 2*b*), and a pseudo-interdigital configuration (FIG. 2*c*). The arrangements of FIGS. 2*a*, 2*b* and 2*c* are designed to overcome in part the perceived disadvantage of making a side coupled half-wave resonator as shown in FIG. 1, where the overall length can be excessive.

FIG. 3 shows a plan view of a 5-pole, interdigital microstrip filter layout disclosed in Schmidt, et al, "Measured Performance at 77 K of Superconducting Microstrip Resonators and Factors", IEEE Transactions on Microwave Theory and Techniques, Vol. 39, No. 9, September, 1991, pp 1475–78. Each resonator 30 is substantially ½ wavelength in length, and each resonator 30 is side coupled to its adjacent resonator. The resonators 30 are substantially aligned relative to one another. This structure will only work in a transmission line structure with unequal coupled line even and odd mode phase velocities (such as in a microstrip configuration) which gives rise to forward coupling.

FIG. 4 shows yet another prior art interdigital filter structure. Here, a 3-wire-line interdigital filter has ¼ wavelengths overlap in ½ wavelength resonators. This structure is disclosed in Levy, "3- Wire-Line Interdigital Filters of Chebyshev and Eliptic Function Characteristic for Broad Bandwidths", Electronic Letters, Vol. 2, pp 13–14, December, 1966. This structure may be used in either a microstrip or strip line configuration. A strip line configuration is one in which the conductor is surrounded by a substantially homogenous dielectric environment. The disclosure of Levy is made with respect to non-superconducting filter structures.

FIG. 5 shows a prior art structure having an end coupled strip line filter formed from superconducting materials. This structure is generally symmetric around the center resonator 50. Intermediate resonators 52 are located between the center resonator 50 and end resonators 54 in an end coupled arrangement. Each of the resonators 50, 52 and 54 is preferably a half wavelength resonator, a ¼ wavelength being designated "λ/4" in FIG. 5. A 50 Ohm input impedance is indicated. This structure is described in Matthaei et al, "High Temperature Superconducting 8.45 GHz Bandpass Filter For the Deep Space Network", presented at 1993 IEEE MTT-5 International Symposium, June 14–18, 1993, Atlanta, Ga., addressed at pages 1273–1276.

A need remains for compact, reliable narrow band filters. Despite the clear desirability of improved electrical circuits, including the known desirability of converting circuitry to include superconducting elements, room remains for improvement in devising alternate structures for filters. It has proved to be especially difficult to substitute high temperature superconducting materials in conventional circuits to form superconducting circuits without severely degrading the intrinsic Q of the superconducting films. Among the problems encountered are radiative losses and tuning, which remain despite the clear desirability of an improved filter. Additionally, size has remained a concern, especially for narrow band filters. For example, the end coupled strip line filters of FIG. 5 a 50 Ohm input impedance is indicated result in long thin structures, which present manufacturing difficulties when formed from superconducting films. Conventionally, the technique for forming narrow band side coupled resonator filter structures as shown in FIGS. 1, 2*a*, 2*b*, 2*c*, 3 and 4 is to space the resonators further apart in order to obtain small coupling coefficients between resonators. However, this approach has two distinct disadvantages, first, the structures become unreasonably large and second, as the distance between resonators increases, the coupling to structures other than adjacent resonators increases, resulting in losses and decreased performance. Additionally, power limitations arise in distributed structures.

Despite the clear desirability in the art for forming narrow bandpass filters to permit efficient use of the frequency spectrum, a need remains for improved designs capable of achieving those results in an efficient and cost effective manner.

SUMMARY OF THE INVENTION

A bandpass filter comprises multiple side-coupled strip line resonators wherein the resonators are offset with respect to one another by less than substantially ¼ wavelength. The resonators are spaced a substantially equal distance apart that are staggered or slipped relative to their nearest neighbor. In the preferred embodiment, a strip line bandpass filter structure has a substantially parallel array of substantially equally spaced ½ wavelength high temperature superconducting resonators. Preferably, the resonators are offset relative to their nearest neighbors by substantially ¼ wavelength or less. The coupling is substantially proportional to the amount of stagger, and for very narrow bandwidths the stagger will be very small. In many applications, the stagger is less than substantially ⅛ wavelength. Generally, the amount of stagger is less for those resonators in the center of the filter relative to their nearest neighbors, as compared to the amount of stagger of resonators near the ends of the filter. Generally, this is a result of the lower value of coupling normally required in the center section of the filter. Coupling between resonators is primarily controlled by introducing a relatively small amount of stagger in positions of resonators. However, the spacing or arrangement may be varied.

Preferably the resonators are formed from planar high temperature superconducting material. Any known high temperature superconducting material including but not limited to YBCO and thallium containing superconducting films may be utilized. Preferably, a hybridized structure is utilized in which mirror image patterns are sandwiched together to form a strip line configuration. Alternatively, a stacked multiple substrate configuration utilizes a first pair of superconducting films to form the resonators, preferably formed from a double sided film, and to ground plane devices. The multiple film structure may be formed with a combination of superconductive and non-superconductive films. In yet an alternative arrangement, the upper dielectric may be removed, keeping the distance from the conductor pattern to the ground plane equal, resulting in a staggered resonator structure which has even and odd phase velocities which are substantially equal.

A narrow bandpass filter results having very low loss in a very compact size.

In another aspect of this invention, a ground plane tuning system utilizes a variable positioning member. Tuning is not normally required, except for demanding applications. In the preferred embodiment, a spaced region exists in the ground plane and a insert is moveable towards and away from the aperture in the ground plane. Most preferably, a threaded plug mates with a threaded housing opening, permitting tuning by rotation of the insert.

Accordingly, it is an object of this invention to form a narrow bandpass filter having a compact size.

It is yet a further object of this invention to provide a narrow bandpass filter having very low loss.

It is yet a further object of this invention to provide a bandpass filter which is simple to manufacture and to use.

It is an object of this invention to provide a bandpass filter structure which utilizes planar fabrication techniques, requiring minimal or no crossovers.

It is yet a further object of this invention to provide a waveguide-like or better performance but in a compact structure.

BRIEF DESCRIPTION OF THE DRAWINGS

FIG. 1 shows a plan view of prior art side-coupled ½ wavelength resonator bandpass filter.

FIGS. 2*a*–2*c* show a plan view of prior art side-coupled ½ wave resonators in a pyramid configuration (FIG. 2*a*), a hairpin construction (FIG. 2*b*) and a pseudo-interdigital construction (FIG. 2*c*).

DETAILED DESCRIPTION OF THE INVENTION

Figure 3:
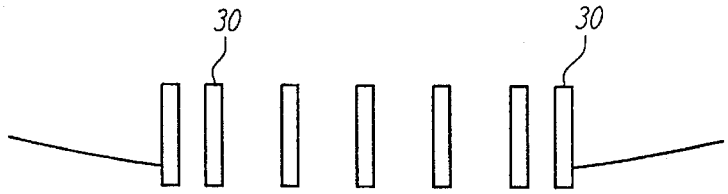
FIG. 3 (PRIOR ART)
FIG. 3 shows a plan view of a prior art microstrip side-coupled resonator formed from high temperature superconducting material having substantially complete resonator overlap.
Figure 4:
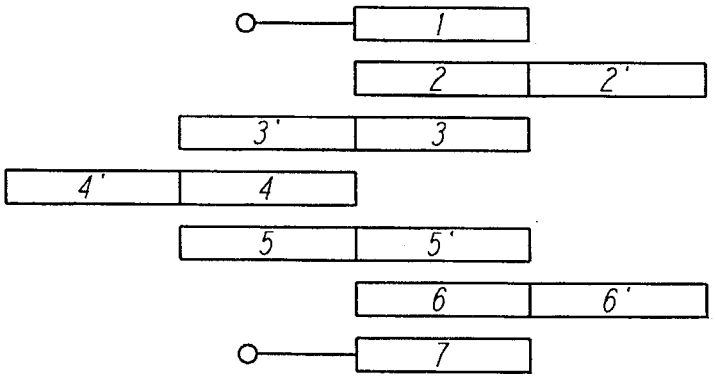
FIG. 4 (PRIOR ART)
FIG. 4 shows a plan view of a prior art arrangement showing side-coupled resonators with ¼ wavelength coupling.
Figure 5:
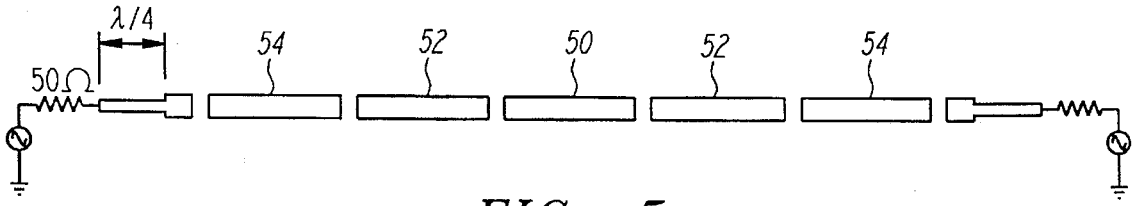
FIG. 5 (PRIOR ART)
FIG. 5 shows a prior art filter in plan view comprising end coupled strip line resonators.
Figure 6:
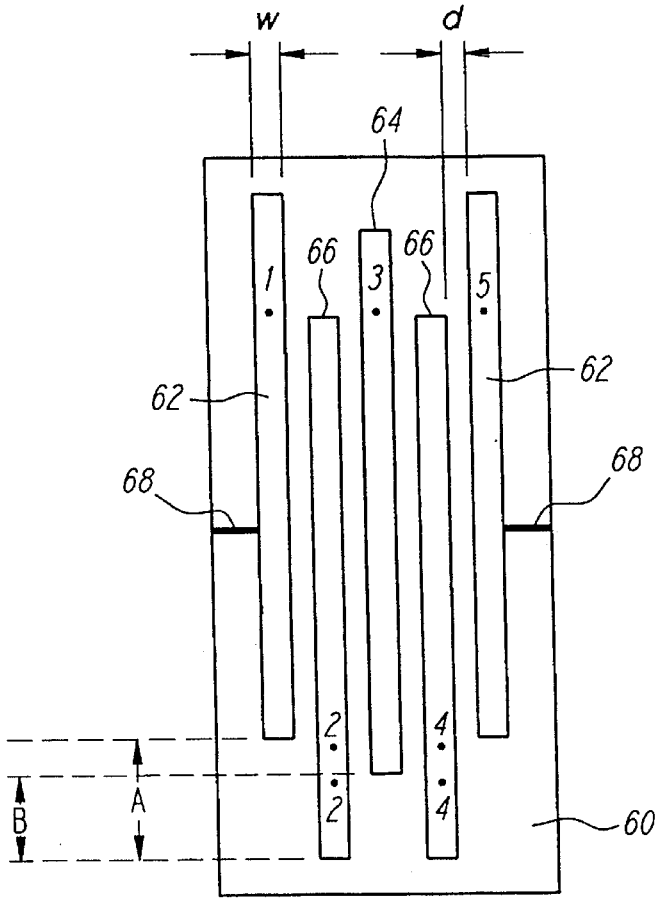
FIG. 6 shows a plan view of a narrow bandpass filter comprising a staggered resonator array.

FIG. 6 shows a plan view of a narrow bandpass filter formed in accordance with this invention. A substrate 60 supports multiple resonators 62, 64 and 66. In this particular structure, 5 resonators are shown, two outside resonators 62 (with designation 1, 5), one center resonator 64 (with designation 3) and two intermediate resonators 66 (with designation 2, 4). Generally, for an odd number of resonators, the filter structure will be symmetric about a line dissecting the center resonator 64 in a lateral direction. Resonator taps 68 provide input and output connections to the filter through the outer resonators 62. The resonators are staggered or offset relative to their nearest neighbor. As shown in FIG. 6, the outer resonator 62 are offset by a distance A relative to the intermediate resonators 66. The intermediate resonator 66 is in turn offset by distance B from the center resonator 64. Generally, the amount of stagger or offset is ¼ wavelength or less, with the offset often being less than ⅛ wavelength. Generally, the amount of stagger or offset between resonators located toward the center of the filter is less than the amount of offset between the resonators closer to the outside of the filter, that is, generally B is less than A.

The substrate 60 may be of any type compatible with the support function for the resonators 62, 64 and 66 and the taps 68. If superconducting materials are utilized, the substrate is preferably lanthanum aluminate, magnesium oxide or sapphire, though generally any substrate capable of supporting high temperature superconducting materials and compatible with radio frequency use may be utilized. The resonators 62, 64 and 66 and taps 68 may be formed from regular metals, such as copper, gold, or silver or high temperature superconducting materials, preferably YBCO or thallium containing materials, though any high temperature superconducting material may be used if compatible with microwave structure use.

The resonators 62, 64 and 66 are ½ wavelength in the preferred embodiment. As is known in the art, the presence of fringing effects means the physical length is slightly less than exactly ½ wavelength. They generally have a width W, which can be arbitrarily chosen or selected to improve power handling. A wide line has better power handling capabilities than a narrow line.

Generally, there are two degrees of freedom for varying the amount of coupling between resonators 62, 64 and 66. First, the offset or stagger between the resonators is the primary mode for varying intraresonator coupling. For a strip line configuration, if all of the resonators are formed as a parallel array with no stagger, there is no pass band. In a strip line configuration, there are equal even and odd mode wave velocities for the coupled lines. Thus, independent of spacing, no coupling occurs and no pass band exists. As the amount of stagger increases, the coupling increases, resulting in a pass band. Generally, the amount of stagger is substantially less than ¼ wavelength. In the most preferred embodiment, the amount of stagger is ⅛ wavelength or less for very narrow bandwidths. However, the amount of stagger is set based upon the amount of coupling needed to result in the formation of a pass band filter. Second, the amount of spacing d between the resonators may be varied. This amount may be constant between the various resonators 62, 64 and 66 or varied between them.

Figure 7:
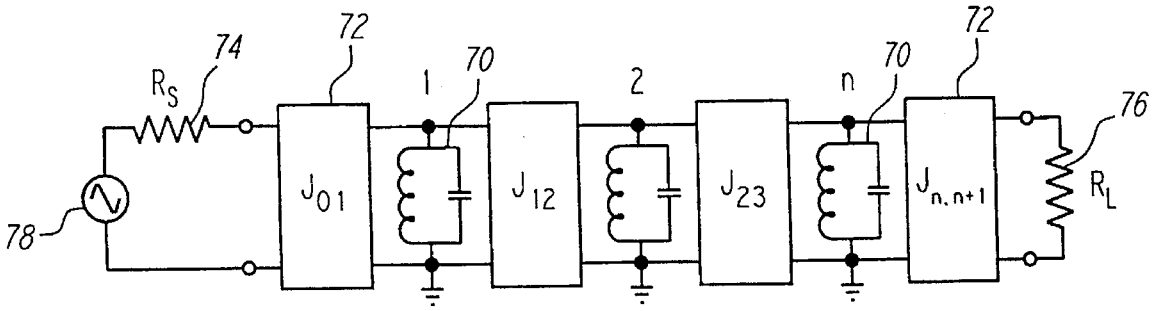
FIG. 7 shows an equivalent circuit for the resonator array bandpass filter.

FIG. 7 shows a circuit schematic for a bandpass filter. Shunt resonators 70 are shown as the combination of an inductor and a capacitor. There are 1, 2, . . . n such resonators 70 shown in FIG. 7. The resonators 70 are separated by admittance inverters 72. A source resistance 74, designated by $R_5$ and load resistance 76 designated by $R_6$, respectively complete the circuit. A driving source 78 provides the input signal.

Figure 8:
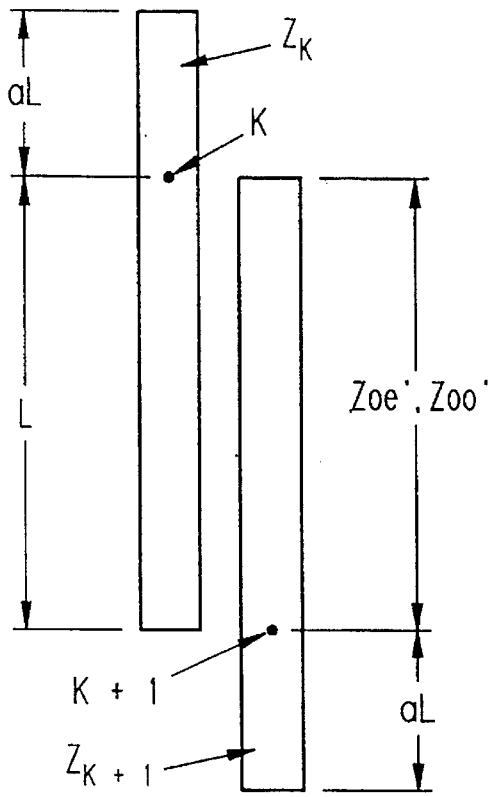
FIG. 8 shows a plan view of a pair of strip line resonators whose coupling is varied by adjusting their amount of overlap.
Figure 9:
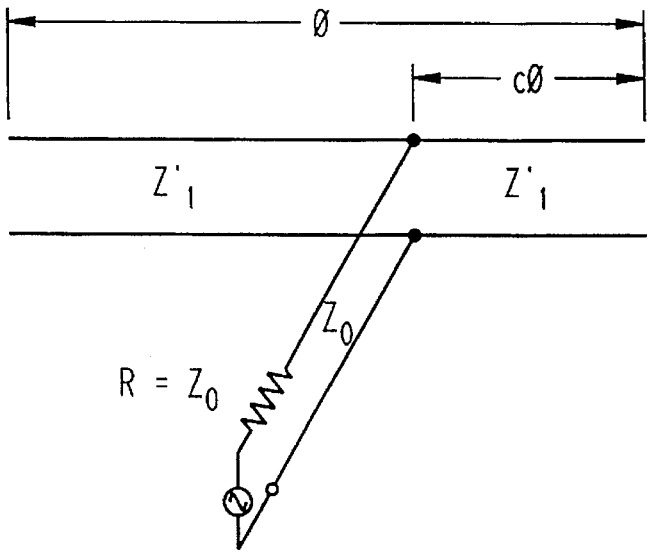
FIG. 9 shows a equivalent circuit for computing the tap location for the end resonators.

FIG. 8 shows a coupled-transmission line equivalent for the definition of Zoe' and Zoo'. The resonator 80 is identified as resonator "k", and resonator 82 is identified as resonator "k+1" to indicate that it is an immediately adjacent resonator. The resonators 80, 82 have an overlap length of "L" and a non-overlapping portion 86 of length "aL". The designation $Z_k$ and $Z_{k+1}$ identify the impedance of the uncoupled line sections, that is, those sections of the resonators which do not overlap with their neighbor resonators. FIG. 9 shows a circuit model of input and output resonators 62 and is used by those skilled in the art to determine the tap location 68 (FIG. 6) to match the source and load characteristic impedance Zo. The impedance Z1' is the impedance of resonator 1 (FIG. 6) in the presence of resonator 2 being rounded. The value π is equal to π at resonance, and "C" fixes the cap point. Other methods to couple in to and out of the filter may be used (e.g., capacitive coupling) without affecting the basic operation of the filter.

Figure 10:
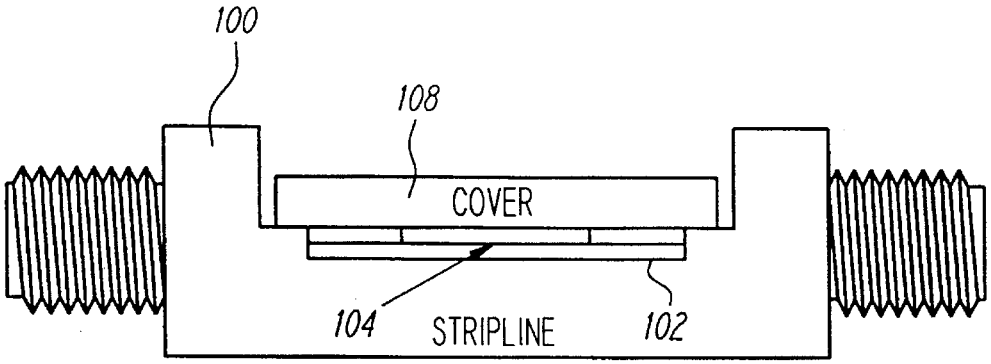
FIG. 10 shows a strip line filter in side view.

FIG. 10 shows a cross-sectional view of the strip line filter in accordance with this invention. A support housing 100 has a recess 102 adapted to receive a substrate 104 bearing the strip line filter 105. A corresponding substrate 106 bears a mirror image strip line pattern 107 and is placed in opposition to the substrate 104 and strip line pattern 105. A cover 108 holds the upper substrate 106 in opposition to the lower substrate 104. In this design, one of the substrates, for example, the lower substrate 104, may have an input or output microstrip transmission line section which may be conveniently connected to the electrical pass through going through the housing 100. Convenient electrical connection is facilitated.

Figure 11:
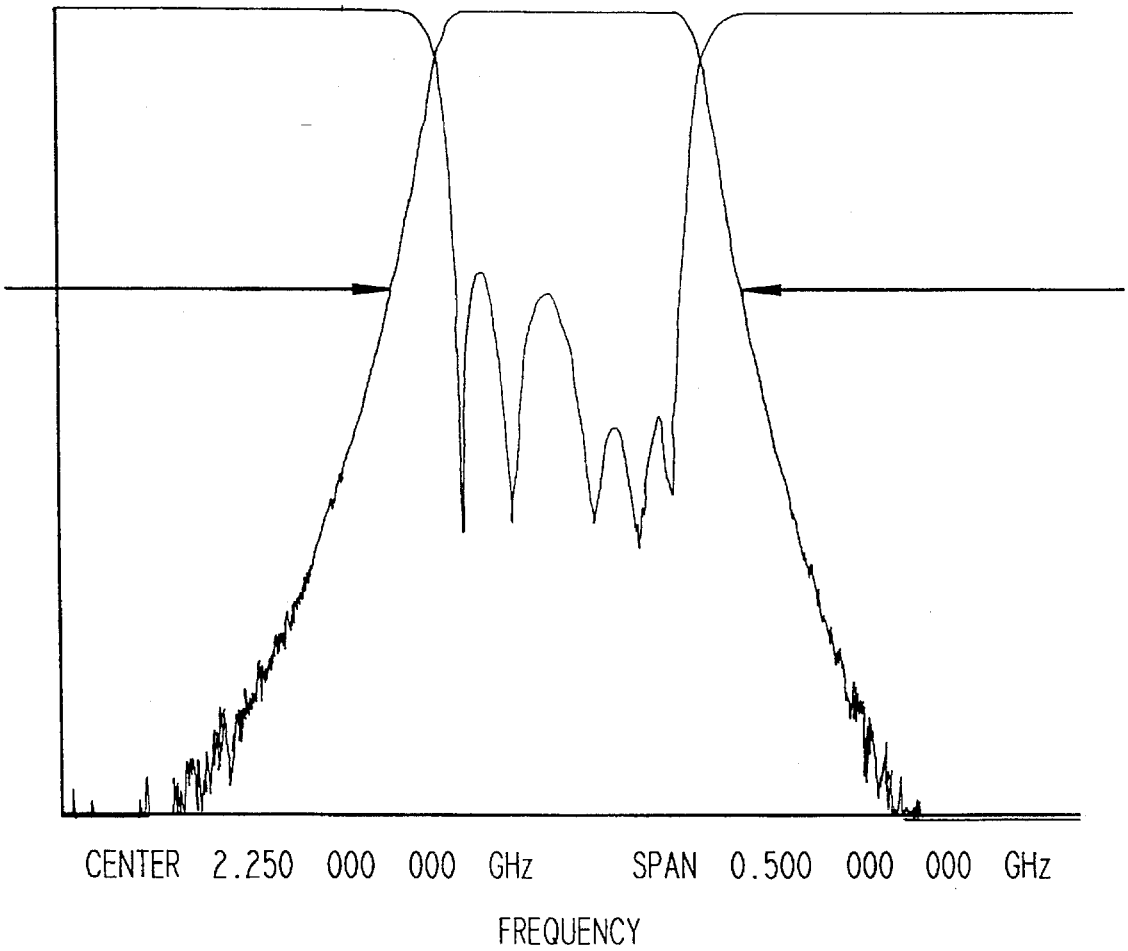
FIG. 11 shows a plot of the insertion loss and return loss for the strip line filter as a function of frequency.

FIG. 11 shows a plot of the electrical characteristics as a function of frequency of a five resonator strip line narrow bandpass filter constructed in accordance with this invention. This figure shows very good insertion loss and return loss performance, with the five resonators clearly evident in the return loss response. This experimental result was achieved without tuning, for even better response it may be necessary to incorporate tuning like that described in FIG. 13 and the accompanying text.

Figure 12A:
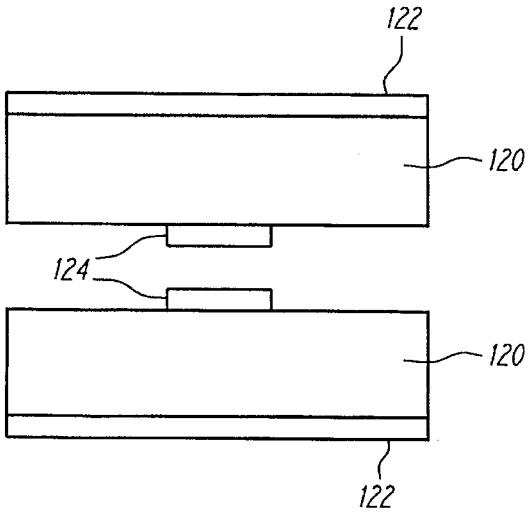
FIGS. 12*a* and 12*b* show a side view of a stacked substrate strip line filter structure having two substrates (FIG. 12*a*) and three substrates (FIG. 12*b*).
Figure 12B:
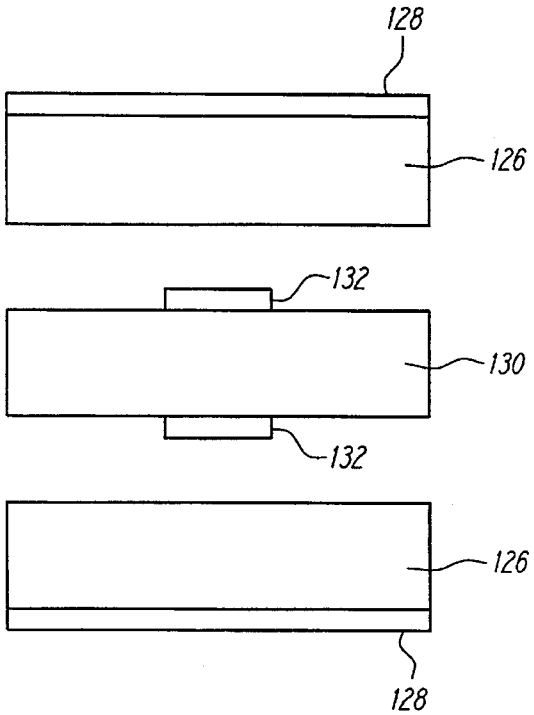

FIGS. 12*a* and 12*b* show alternative arrangements for formation of the strip line narrow bandpass filter of this invention. FIG. 12*a* shows a filter formed from two double sided films 120. Each film is preferably formed as a mirror image of the other film 120. Generally, a ground plane 122 is disposed on the outer side of the substrate 120. The resonators 124 are patterned on the inside of the substrate 120. In the preferred embodiment, the ground plane 122 and filter 124 comprise double sided films formed on the single substrate 120. FIG. 12*b* shows a three substrate arrangement in which the outer substrates 126 support the ground plane 128, and the interior substrate 130 supports the filter structures 132 on each side of the substrate 130. The ground plane film 128 may be formed on one side of the substrate 126. Alternatively, these substrates bearing the ground plane film 128 may be double sided films similar to those formed on substrate 120 in FIG. 12(*a*) which include the mirror image of circuit film 124 on the other side from the ground plane. In the preferred embodiment, the interior substrate 130 bears a double sided film formed as filter 132.

Figure 13:
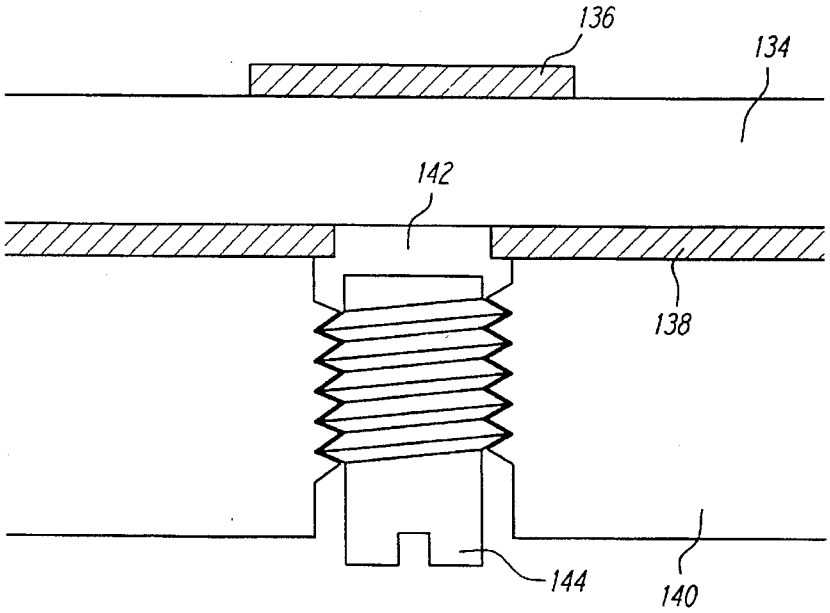
FIG. 13 shows a side view of a ground-plane tuning structure.

FIG. 13 shows a cross-sectional view of a ground plane tuning device useful for both strip line and microstrip circuits. While not necessary in connection with the use of the staggered array concept of this invention, the ground plane tuning structure may optionally be used and provide advantageous results. Generally, a substrate 134 supports a circuit pattern 136. A ground plane 138 is disposed upon the substrate 134 on the side opposite from the circuit pattern 136. Preferably, this arrangement is then supported on a housing 140. Preferably, ground plane 138 includes an aperture within it, preferably located proximally to the circuit pattern 136. A moveable conductive member 144 moves relative to the aperture 142 to provide tuning of the structure comprising the circuit pattern 136. In the preferred embodiment, the tuning member 134 is moveable towards and away from the circuit pattern 136 by rotational motion of a conventional spreading arrangement.

Although the invention has been described with respect to specific preferred embodiments, many variations and modifications may become apparent to those skilled in the art. It is therefore the intention that the appended claims be interpreted as broadly as possible in view of the prior art to include all such variations and modifications.

We claim:

1. A bandpass filter in strip line configuration comprising:

an input tap and an output tap, a first outside resonator and a second outside resonator, the first outside resonator being connected to the input tap and the second outside resonator being connected to the output tap, and an additional odd number of resonators including, a center resonator and one or more intermediate resonators disposed between each of the first and second outside resonators and the center resonator, characterized in that the resonators are offset from their nearest neighbor resonator by a distance less than ¼ wavelength of the signal applied to the filter, the filters being arranged such that they are symmetric about a line dissecting the center resonator in a lateral direction.

2. The bandpass filter of claim 1 wherein the amount of offset between resonators adjacent to the center resonator of the filter is less than the amount of offset between the outside resonators and their nearest neighbor resonator.

3. The bandpass filter of claim 1 wherein a linear spacing between the resonators is not uniform.

* * * * *